US010061234B2

(12) United States Patent
Sasaki et al.

(10) Patent No.: US 10,061,234 B2
(45) Date of Patent: Aug. 28, 2018

(54) FIXING APPARATUS AND IMAGE FORMING APPARATUS FOR CONTROLING POWER SUPPLIED TO HEATER BASED ON TEMPERATURE DETECTION

(71) Applicant: Konica Minolta, Inc., Chiyoda-ku, Tokyo (JP)

(72) Inventors: Kosuke Sasaki, Yokohama (JP); Masashi Sugano, Hachioji (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/266,513

(22) Filed: Sep. 15, 2016

(65) Prior Publication Data

US 2017/0082959 A1 Mar. 23, 2017

(30) Foreign Application Priority Data

Sep. 18, 2015 (JP) ..... 2015-184661

(51) Int. Cl.
*G03G 15/20* (2006.01)
*G03G 15/00* (2006.01)

(52) U.S. Cl.
CPC ..... *G03G 15/2039* (2013.01); *G03G 15/2078* (2013.01); *G03G 15/80* (2013.01)

(58) Field of Classification Search
CPC ..... G03G 15/2039; G03G 15/80; G03G 15/2078; G03G 15/5004
(Continued)

(56) References Cited

U.S. PATENT DOCUMENTS 8,260,165 B2 * 9/2012 Chosokabe ..... G03G 15/80 219/216
9,471,013 B2 * 10/2016 Asano ..... G03G 15/2039
(Continued)

FOREIGN PATENT DOCUMENTS

JP 10312133 A * 11/1998
JP 2006164615 A * 6/2006
(Continued)

OTHER PUBLICATIONS

Office Action (Notice of Reasons for Rejection) dated Sep. 26, 2017 by the Japanese Patent Office in corresponding Japanese Patent Application No. 2015-184661 and an English Translation of the Office Action. (12 pages).

*Primary Examiner* — Robert Beatty
(74) *Attorney, Agent, or Firm* — Buchanan Ingersoll & Rooney PC

(57) ABSTRACT

A fixing apparatus configured to fix a coloring material attached to a recording medium by heating the recording medium by using a fixing member includes: a heater configured to heat the fixing member; an AC power source configured to apply AC voltage to the heater; a temperature detection unit configure to detect a temperature of the heater; and a power control unit configured to control drive power supplied to the heater from the AC power source by calculating an application pattern of AC voltage to be applied to the heater based on an output of the temperature detection unit, and by appropriately selecting a half wave of AC waveform from the AC power source based on the application pattern, wherein the power control unit supplies power equivalent to a waveform with a predetermined phase angle on a non-selected half wave from the AC power source to the heater.

12 Claims, 7 Drawing Sheets

(58) Field of Classification Search
USPC ..... 399/69, 88; 219/216
See application file for complete search history.

(56) References Cited

U.S. PATENT DOCUMENTS

| | | | | |
|---|---|---|---|---|
| 2011/0064444 | A1* | 3/2011 | Adachi | G03G 15/80 399/69 |
| 2011/0299868 | A1* | 12/2011 | Ito | G03G 15/2039 399/69 |
| 2014/0003830 | A1* | 1/2014 | Higashi | G03G 15/5004 399/69 |
| 2016/0044745 | A1* | 2/2016 | Nakayama | G03G 15/2039 219/481 |

FOREIGN PATENT DOCUMENTS

| | | | | |
|---|---|---|---|---|
| JP | 2010237283 | A * | 10/2010 | G03G 15/2039 |
| JP | 2011-64712 | A | 3/2011 | |
| JP | 2013-222097 | A | 10/2013 | |

* cited by examiner

FIXING APPARATUS AND IMAGE FORMING APPARATUS FOR CONTROLING POWER SUPPLIED TO HEATER BASED ON TEMPERATURE DETECTION

The entire disclosure of Japanese Patent Application No. 2015-184661 filed on Sep. 18, 2015 including description, claims, drawings, and abstract are incorporated herein by reference in its entirety.

BACKGROUND OF THE INVENTION

Field of the Invention

The present invention relates to a fixing apparatus and an image forming apparatus.

Description of the Related Art

As a known art in a fixing apparatus, there is a control method (wave number control) of generating an application pattern by appropriately selecting a half wave of an AC waveform as a drive power for a heater and supplying the generated application pattern to the heater as drive power (refer to JP 2013-222097 A).

For example, the temperature of the heater can be properly controlled by appropriately controlling the number of half waves supplied in a predetermined cycle, namely, a duty ratio of the application pattern, corresponding to the magnitude of the drive power to be supplied.

Meanwhile, there is a disclosed image forming apparatus that performs phase control, specifically, supplies the drive power to the heater by turning on a switching element on a certain phase angle within a half wave of the AC waveform in order to suppress fluctuation, namely, flickering of an illumination apparatus (refer to JP 2013-222097 A).

It would be true that the wave number control on the image forming apparatus described in JP 2013-222097 A would cause no problem in a case where the drive power with a high duty ratio on the application pattern is supplied to the heater. Unfortunately, however, in a case where the drive power with a low duty ratio on the application pattern is supplied to the heater, an interval between the half waves of the AC waveform might increase and lower the heater temperature in a period when the half wave of the AC waveform is not supplied. This would cause, in a case where the half wave of the AC waveform half is supplied again, generation of inrush current in the heater and lead to generation of flickering.

SUMMARY OF THE INVENTION

An object of the present disclosure is to provide a fixing apparatus and an image forming apparatus capable of preventing generation of flickering even in a case where the duty ratio on an application pattern is low.

To achieve the abovementioned object, according to an aspect of the disclosure, a fixing apparatus configured to fix a coloring material attached to a recording medium by heating the recording medium by using a fixing member, reflecting one aspect of the present invention comprises: a heater configured to heat the fixing member; an AC power source configured to apply AC voltage to the heater; a temperature detection unit configure to detect a temperature of the heater; and a power control unit. The power control unit is configured to control drive power supplied to the heater from the AC power source by calculating an application pattern of AC voltage to be applied to the heater based on an output of the temperature detection unit, and by appropriately selecting a half wave of AC waveform from the AC power source based on the application pattern. The power control unit supplies power equivalent to a waveform with a predetermined phase angle on a non-selected half wave, from the AC power source to the heater, according to a duty ratio of the application pattern.

According to an aspect of the disclosure, the power control unit preferably supplies, to the heater, power equivalent to a waveform with a predetermined phase angle on all of non-selected half waves.

According to an aspect of the disclosure, the power control unit preferably supplies, to the heater, power equivalent to a waveform with a predetermined phase angle on a portion of non-selected half waves.

According to an aspect of the disclosure, the power control unit preferably controls such that a period after supply of the drive power till supply of power equivalent to a waveform with a predetermined phase angle on a non-selected half wave becomes longer than an interval after supply of power equivalent to a waveform with a predetermined phase angle on a half wave on the non-selected half wave till supply of power equivalent to a waveform with a predetermined phase angle on a non-selected half wave.

According to an aspect of the disclosure, the power control unit preferably controls the phase angle based on a heat storage amount of the heater.

According to an aspect of the disclosure, the fixing apparatus preferably comprises a plurality of heaters, and the power control unit preferably controls, based on a heat storage amount of the heater, such that a period, on a first heater, in which power equivalent to a waveform with a predetermined phase angle is not supplied is varied from a period, on a second heater, in which power equivalent to a waveform with a predetermined phase angle is not supplied.

To achieve the abovementioned object, according to an aspect of the disclosure, an image forming apparatus reflecting one aspect of the present invention comprises: an image forming unit configured to form a toner image on a recording medium; and a fixing apparatus according to the present disclosure configured to fix the toner image to the recording medium by causing the recording medium on which the toner image is formed to pass through the fixing apparatus.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, specific aspects of the present invention will be described with reference to the drawings. However, the scope of the invention is not limited to the illustrated examples.

Embodiments

[1. Description of Configuration]

Figure 1:
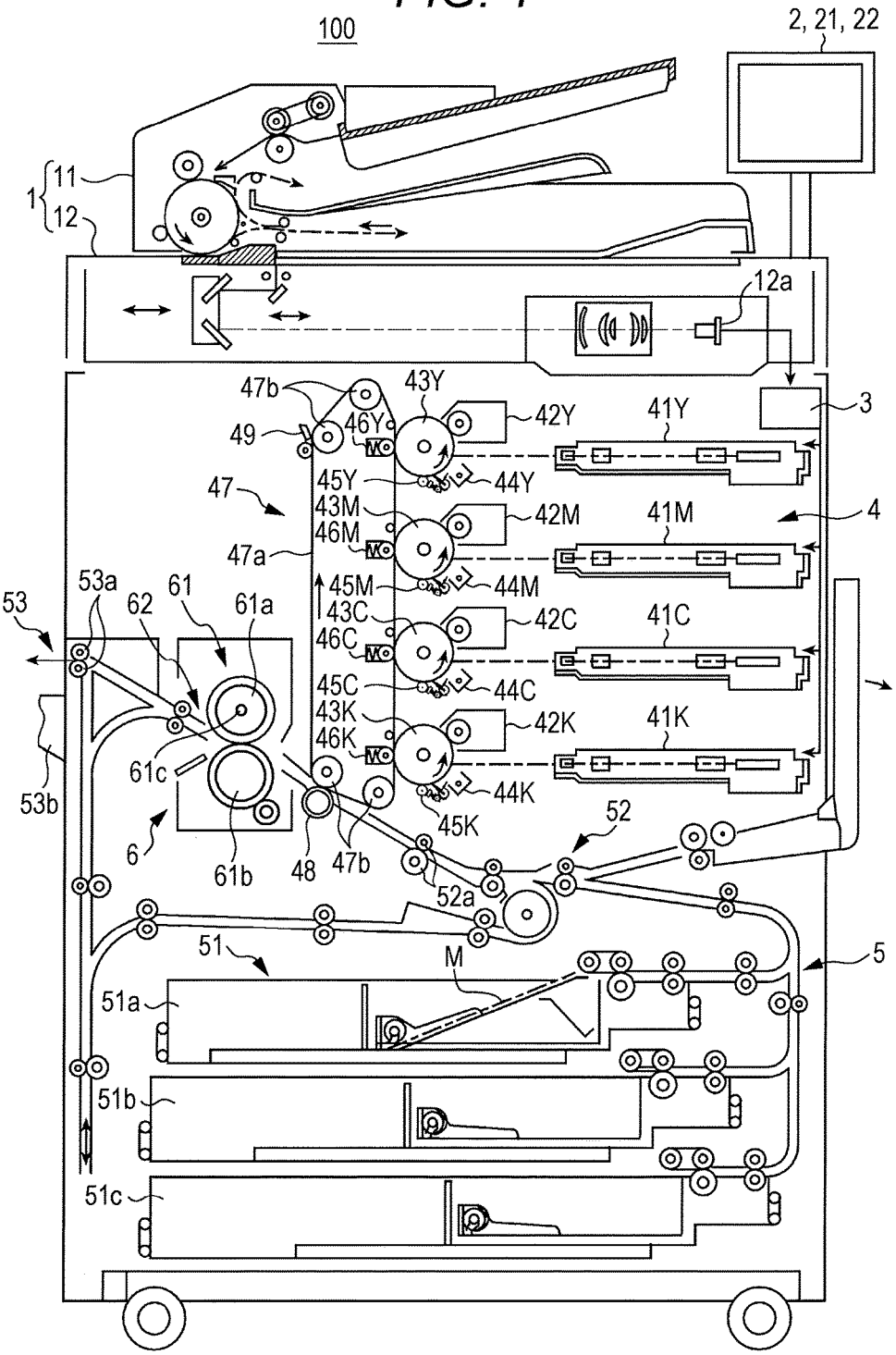
FIG. 1 is a diagram illustrating a schematic configuration of an image forming apparatus according to an embodiment of the present invention.
Figure 2A:
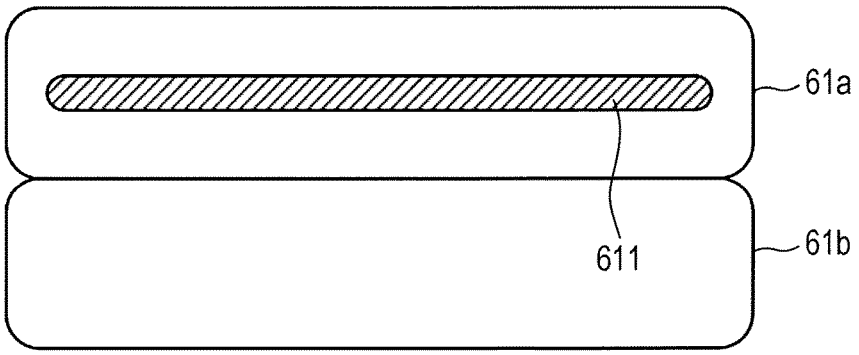
FIGS. 2A and 2B are schematic diagrams and control circuit diagrams enlarging a roller portion of a fixing apparatus.
Figure 2B:
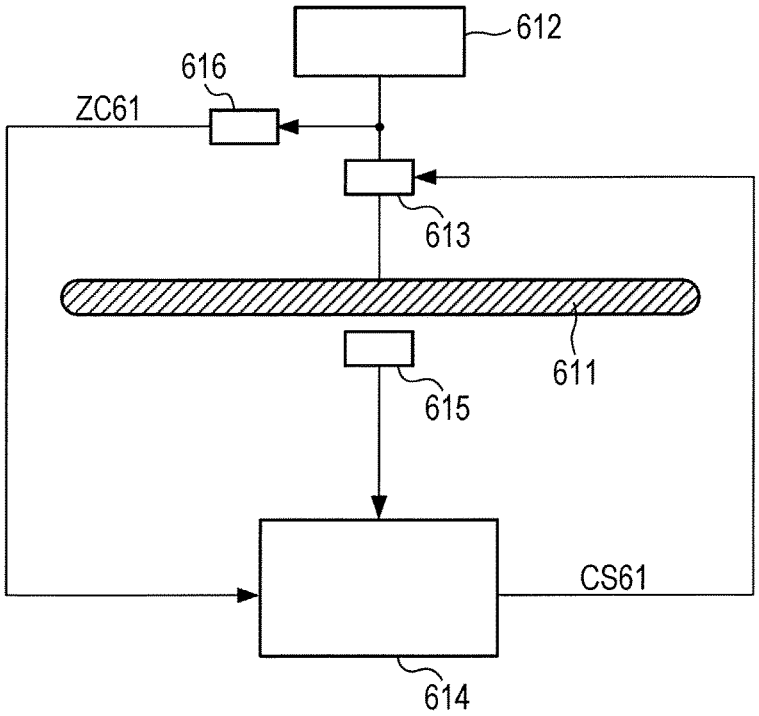

FIG. 1 is a diagram illustrating a schematic configuration of an image forming apparatus 100 according to an embodiment of the present invention. FIGS. 2A and 2B are schematic diagrams and control circuit diagrams enlarging a roller portion of a fixing apparatus.

As illustrated in FIGS. 1 to 2B, the image forming apparatus 100 according to the present embodiment forms an image by overlapping colors on a sheet (recording medium) M based on image data obtained by reading a color image formed on a document or based on image data input from an external information apparatus (for example, a personal computer) via a network.

The image forming apparatus 100 is a tandem-type image forming apparatus in which photoreceptor drums 43Y, 43M, 43C, and 43K each of which corresponding to four colors of yellow (Y), magenta (M), cyan (C), and black (K) are serially arranged in a travelling direction of an intermediate transfer belt 47*a* and configured to sequentially transfer toner images of individual colors to a transfer body with one procedure.

Specifically, the image forming apparatus 100 according to the present embodiment includes an image reading unit 1, an operation display unit 2, an image processing unit 3, an image forming unit 4, a conveyance unit 5, a fixing apparatus 6, and a control unit (not illustrated).

The image reading unit 1 includes an automatic document feeder 11, which is abbreviated as an ADF, and a document image scanner (scanner) 12.

The automatic document feeder 11 conveys, via a conveyance mechanism, a document placed in a document tray, and feeds the document to the document image scanner 12. The automatic document feeder 11 can collectively read images (including double-sided image) on a large number of documents placed in the document tray.

The document image scanner 12 optically scans the document conveyed onto a contact glass portion from the automatic document feeder 11 or the document placed on the contact glass portion, and reads a document image by collecting reflected light from the document to form an image on a light receiving plane of a charge coupled device (CCD) sensor 12*a*. The image (analog image signal) read by the image reading unit 1 undergoes predetermined image processing on the image processing unit 3.

Herein, the image includes not only image data including graphic/photographic data but also textual data including characters and signs, and other data.

The operation display unit 2 includes a liquid crystal display (LCD) having a touch panel and functions as a display unit 21 and an operation unit 22.

According to a display control signal input from the control unit, the display unit 21 displays various operation screens, image condition display, individual function operation status, or the like.

The operation unit 22 includes various operation keys such as a ten-key pad, or a start key, receives various input operation from a user, and outputs an operation signal to the control unit.

The image processing unit 3 includes a circuit that performs analog/digital (A/D) conversion processing, and a circuit that performs digital image processing.

The image processing unit 3 generates digital image data (RGB signal) by performing A/D conversion processing on the analog image signal from the image reading unit 1. The image processing unit 3 performs, on the digital image data, color conversion processing, gradation reproduction processing (screen processing, etc.), correction processing (shading processing, etc.) corresponding to initial setting or user setting, compression processing, or the like. The image forming unit 4 is controlled based on the digital image data (YMCK signal) that have undergone these types of processing.

The image forming unit 4 includes exposure apparatuses 41Y, 41M, 41C, and 41K, developing apparatuses 42Y, 42M, 42C, and 42K, photoreceptor drums 43Y, 43M, 43C, and 43K, charging apparatuses 44Y, 44M, 44C, and 44K, lubricant application and removal units 45Y, 45M, 45C, and 45K, primary transfer rollers 46Y, 46M, 46C, and 46K, and intermediate transfer unit 47, each being provided corresponding to each of different color components Y, M, C, and K.

The charging apparatus 44Y charges the photoreceptor drum 43Y on a Y-component unit on the image forming unit 4. The exposure apparatus 41Y includes, for example, a semiconductor laser, and emits laser light corresponding to the Y-component toward the photoreceptor drum 43Y. With this procedure, an electrostatic latent image of the Y-component is formed on a surface of the photoreceptor drum 43Y. The developing apparatus 42Y contains Y-component developer (e.g., two-component developer formed of small-particle toner and magnetic body), and develops an electrostatic latent image (toner image formation) by attaching Y-component toner onto a surface of the photoreceptor drum 43Y.

In a same manner, toner images of other colors are formed on surfaces of the corresponding photoreceptor drums 43M, 43C, and 43K, on units for M-component, C-component, and K-component, respectively.

Each of the lubricant application and removal units 45Y, 45M, 45C, and 45K applies lubricant onto each of the surfaces of the photoreceptor drums 43Y, 43M, 43C, and 43K, and together with this, removes excessive lubricant and foreign objects attached on the surface of the photoreceptor drums 43Y, 43M, 43C, and 43K, respectively.

The intermediate transfer unit 47 includes an intermediate transfer belt 47*a*, namely, a transfer body having an endless form, arranged to be stretched across a plurality of support rollers 47*b*, . . . .

When the intermediate transfer belt 47*a* are press-contacted by the primary transfer roller 46Y, 46M, 46C, and 46K, to the photoreceptor drums 43Y, 43M, 43C, and 43K, respectively, individual color toner images are sequentially overlapped and primary-transferred onto the intermediate transfer belt 47*a*. Subsequently, the primary-transferred intermediate transfer belt 47*a* is press-contacted onto the sheet M by a secondary transfer roller 48, whereby the toner image is secondary-transferred onto the sheet M The toner remaining on the intermediate transfer belt 47*a* after the secondary transfer is removed by a blade, or the like, of a cleaning apparatus 49.

The conveyance unit 5 includes a sheet supply apparatus 51, a conveyance mechanism 52, and a sheet discharge apparatus 53.

The sheet supply apparatus 51 includes three sheet supply tray units 51*a* to 51*c*. In the sheet supply tray units 51*a* to 51*c*, standard sheets and special sheets identified based on the grammage and size of the sheet M are contained being classified into each of preset types. The sheet M contained in the sheet supply tray units 51*a* to 51*c* is fed one by one from the topmost portion, and conveyed to the image forming unit 4 by a conveyance mechanism 52 including a plurality of conveyance rollers such as a registration roller 52*a*. At this time, a registration unit including the registration roller 52*a* corrects inclination of the supplied sheet M and adjusts conveyance timing.

The sheet supply apparatus 51 includes a manual feed tray unit 51*d* for manually feeding the sheet M.

Subsequently, the toner image of the intermediate transfer belt 47*a* is collectively secondary-transferred onto an image forming surface of the sheet M on the image forming unit 4, and then, undergoes a fixing step on the fixing apparatus 6. The sheet M on which an image is formed is discharged onto an external sheet discharge tray 53*b* by the sheet discharge apparatus 53 including a sheet discharge roller 53*a*.

The fixing apparatus 6 includes a fixing roller 61*a* as a fixing member, and a pressure roller 61*b*. The fixing apparatus 6 performs fixing processing on a toner image, as a coloring material, transferred onto the sheet M. The fixing roller 61*a* and the pressure roller 61*b* are formed as a nip portion configured to hold and convey the sheet M.

The fixing roller 61*a* is arranged on an image forming surface side of the sheet M. The fixing roller 61*a* rotates together with the drive of a drive means such as a motor (not illustrated).

The fixing roller 61*a* includes, for example, an elastic layer formed of silicone rubber, or the like, around an external peripheral surface of a cylindrical core metal portion made of iron. The fixing roller 61*a* incorporates a fixing heater 61*c* such as a halogen heater, comes in contact with an image forming surface of the sheet M onto which a toner image is transferred, and heats the sheet M with a predetermined fixing temperature. In other words, the fixing roller 61*a*, while rotating, comes in contact with the image forming surface of the sheet M and heats the sheet M.

The predetermined fixing temperature is the temperature capable of supplying the amount of heat required to melt the toner when the sheet M passes through the nip portion and differs depending on factors including the type of sheet M used for image forming.

The pressure roller 61*b* is arranged to face the fixing roller 61*a*, being pressed by the fixing roller 61*a* with a predetermined pressing force. In other words, the pressure roller 61*b* functions as a pressure unit, similarly to the fixing roller 61*a*, configured to hold and pressurize the sheet M.

The pressure roller 61*b* includes, for example, an elastic layer formed of silicone rubber, or the like, around an external peripheral surface of a cylindrical core metal portion made of iron, for example. By forming the surface of the pressure roller 61*b* harder relatively to the surface of the fixing roller 61*a*, the pressure roller 61*b* forms a nip portion with a shape that bites into the elastic layer on a surface of the fixing roller 61*a*, while being pressed against the fixing roller 61*a*.

[2. Description of Configuration of Fixing Apparatus]

FIG. 2A is a schematic diagram enlarging a roller portion of the fixing apparatus 6. FIG. 2B is a control circuit diagram of a heater 611.

As illustrated in FIG. 2A, the heater 611 is provided inside the fixing roller 61*a*.

An AC power source 612 outputs ordinary AC power (e.g., 100 V, 50 Hz, or 60 Hz).

A switching element 613 is an element such as a thyristor and a two-way thyristor (triac), and is turned on to be conductive when a trigger signal is applied onto a gate as a control terminal. The output of the AC power source 612 is connected to an input terminal of the switching element 613, and an output terminal is connected to a power input terminal of the heater 611.

A control unit 614 performs temperature control of the heater 611. Specifically, the control unit 614 controls the switching element 613 by a control signal, selects a half wave of the AC waveform output from the AC power source 612 and supplies it to the heater 611. In addition, a wave form with a predetermined phase angle is selected on a non-selected half wave, according to the duty ratio, and supplies power equivalent to the waveform of the phase angle, to the heater 611.

A temperature detection unit 615 is a temperature detection element such as a temperature sensor, provided in the vicinity of the heater 611, detects the temperature of the heater 611 and outputs it to the control unit 614.

A zero-cross detector 616 captures the output of the AC power source 612, generates a zero-cross signal ZC61 and outputs the generated signal to the control unit 614.

[3. Description of Selection of Half Wave of AC Waveform]

A method for selecting a half wave of an AC waveform output from the AC power source 612, and supplying it to the heater 611, performed by the switching element 613, will be described with reference to the FIGS. 3A to 3C.

Figures 3A, 3B, 3C:
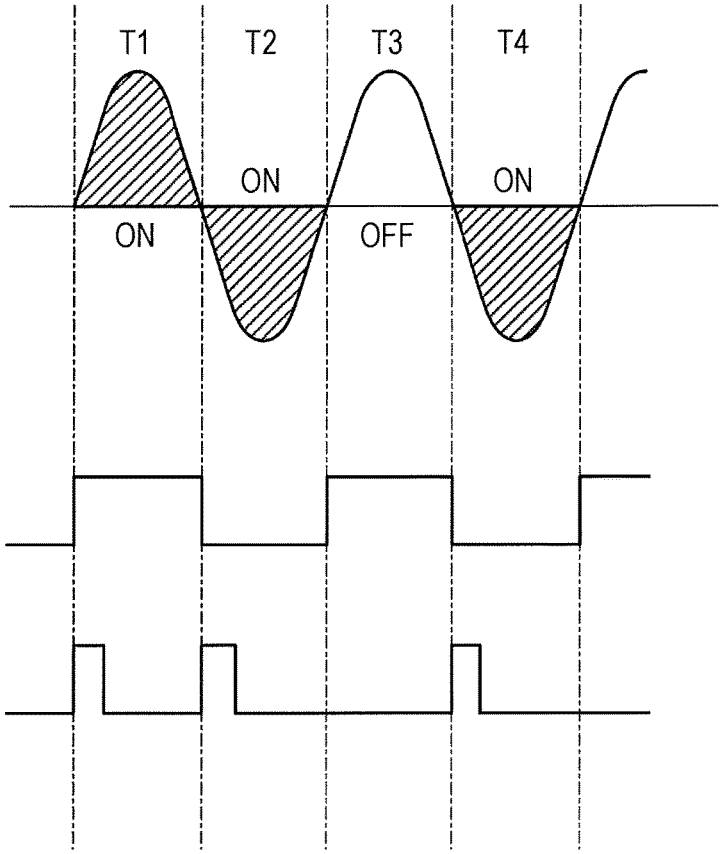
FIGS. 3A to 3C are diagrams illustrating exemplary half wave selection operation on an AC waveform.

As illustrated in FIG. 3B, the zero-cross detector 616 detects a point at which the AC waveform output from the AC power source 612 crosses ±0V, generates the zero-cross signal ZC61 for which an output value is switched, at the point of detection, and outputs the zero-cross signal ZC61 to the control unit 614.

As illustrated in FIG. 3C, the control unit 614 generates a control signal CS61 synchronized with the zero-cross signal ZC61, and applies the control signal CS61 to a control terminal of the switching element 613.

More specifically, as illustrated in FIGS. 3A to 3C, at a cycle T1, a cycle T2, and a cycle T4, to which the control signal CS61 is applied from the control unit 614, the switching element 613 is turned on to be conductive and then, a half wave of the AC waveform output from the AC power source 612 is selected and supplied to the heater 611.

In contrast, at a cycle T3 to which the control signal CS61 is not applied from the control unit 614, the switching element 613 remains off to be non-conductive and thus, a half wave of the AC waveform output from the AC power source 612 is not selected.

The switching element 613 remains to be conductive once a trigger signal (control signal) is applied to a gate. However, as in this case of the AC waveform, when the voltage becomes 0V, the conductive state of the switching element 613 returns to non-conductive state. Accordingly, even in a case where the switching element 613 becomes conductive at the cycle T2, it automatically returns to non-conductive state at the cycle T3.

[4. Description of Operation of Selecting Waveform with Predetermined Phase Angle]

A method for selecting, by the switching element 613, a waveform with a predetermined phase angle on a half wave of the AC waveform output from the AC power source 612, and supplying the power equivalent to the waveform of the phase angle, to the heater 611, will be described with reference to FIGS. 4A to 4C. Note that description overlapping with [3. Description of Selection of Half Wave of AC Waveform] will be appropriately omitted.

Figures 4A, 4B, 4C:
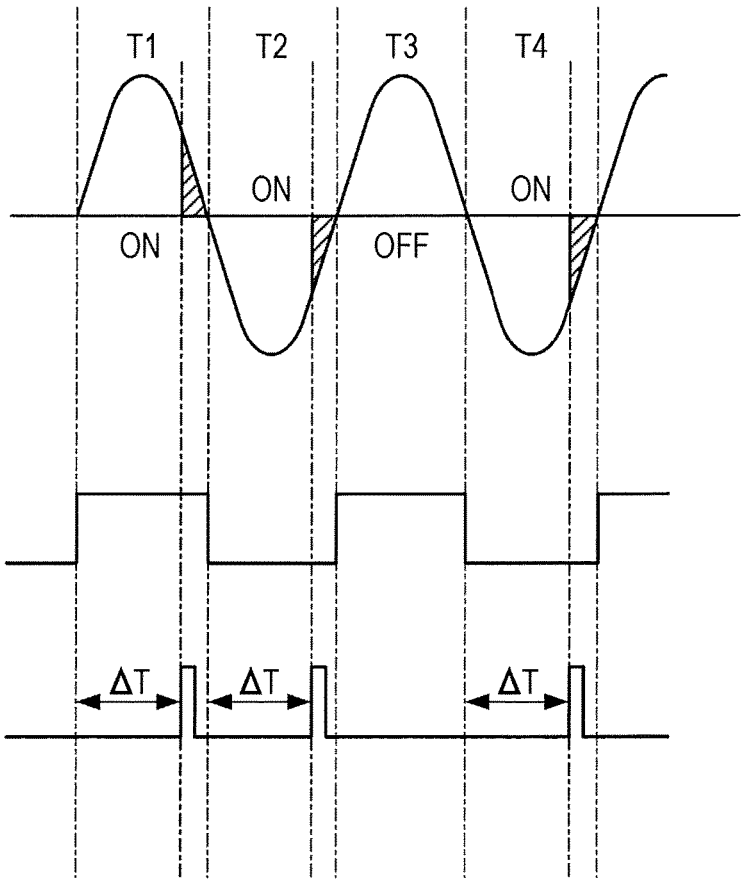
FIGS. 4A to 4C are diagrams illustrating exemplary selection operation of a waveform with a predetermined phase angle, on a half wave of an AC waveform.

As illustrated in FIG. 4C, the control unit 614 generates the control signal CS61 that is delayed for predetermined time ΔT by a timer circuit, or the like, in response to a change point of the zero-cross signal ZC61 as a trigger, and applies the control signal CS61 to the control terminal of the switching element 613.

In other words, as illustrated in FIGS. 4A to 4C, a waveform with a predetermined phase angle is selected on a half wave in the cycle T1, the cycle T2, and the cycle T4, to each of which the control signal CS61 has been applied from the control unit 614, that is, selected on a half wave of the AC waveform output from the AC power source 612 after the switching element 613 is turned on to be conductive in synchronization with rising of the control signal CS61. Accordingly, the power equivalent to the waveform with the phase angle is supplied to the heater 611. The predetermined phase angle can be varied by appropriately setting the above-described predetermined time ΔT.

[5. Description of Operation of Fixing Apparatus]

Figure 5:
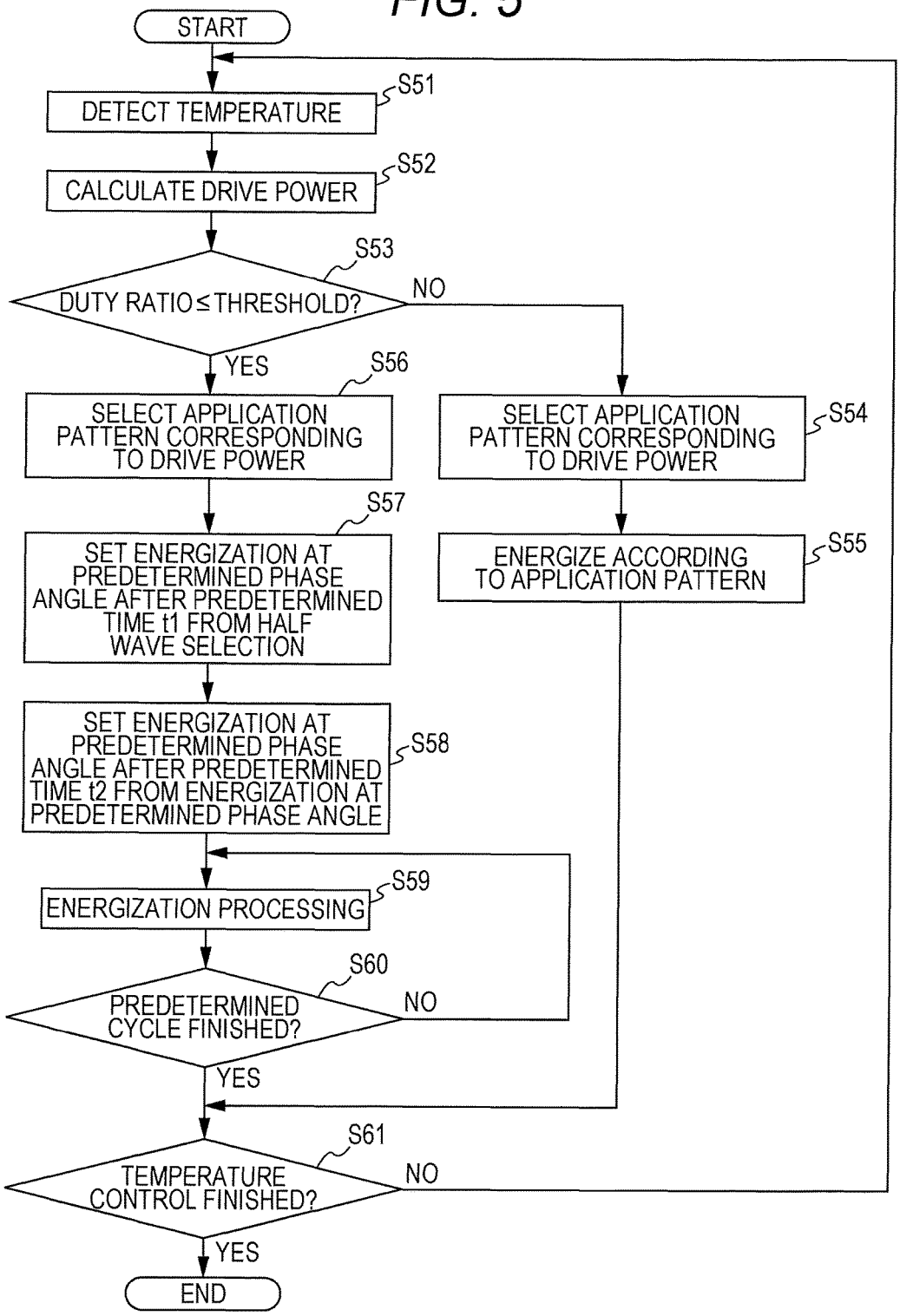
FIG. 5 is a flowchart illustrating exemplary control operation of a control unit.
Figure 6A:
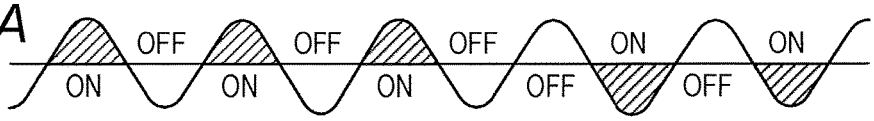
FIGS. 6A to 6F are diagrams illustrating an exemplary application pattern.
Figure 6B:
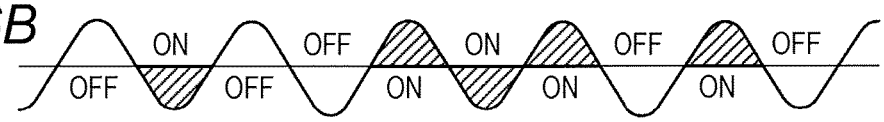
Figure 6C:
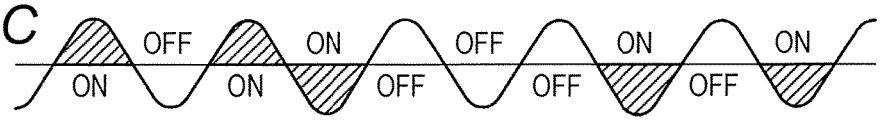
Figure 6D:
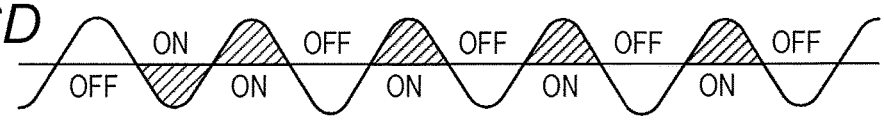
Figure 6E:
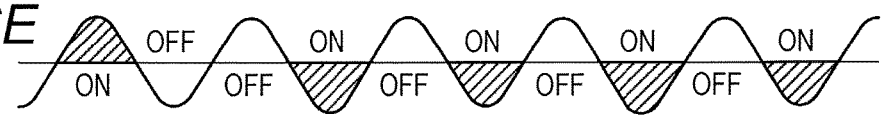
Figure 6F:
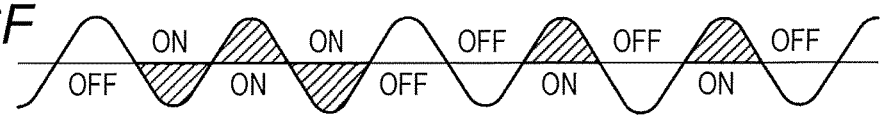

Operation of the fixing apparatus 6 will be described with reference to the flowchart in FIG. 5.

The control unit 614 captures the output from the temperature detection unit 615, detects the temperature of the heater 611 (step S51), and calculates drive power based on a difference between the temperature of the heater 611 detected by the temperature detection unit 615 and the target temperature (step S52).

For example, based on the difference between the temperature of the heater 611 detected by the temperature detection unit 615 and the target temperature, the control unit 614 as a calculation unit calculates drive power, specifically, a duty ratio (the number of half waves of an AC waveform to be selected in a predetermined cycle).

Specifically, the drive power is calculated using a proportional-integral-derivative (PID) controller, by three elements, namely, deviation between the detected heater temperature and the target temperature, its integral value, and its differential value.

The control unit 614 determines whether the duty ratio is a predetermined threshold or below (step S53), and in a case where it is determined that the duty ratio is greater than the predetermined threshold (step S53: No), selects an application pattern that satisfies the duty ratio (step S54), energizes the heater 611 according to the selected application pattern (step S55), and moves on to step S61.

Herein, the application pattern means a pattern in which half waves of the AC waveform with a predetermined cycle are selected based on the duty ratio. FIGS. 6A to 6F are diagrams illustrating exemplary application patterns. All of FIGS. 6A to 6F illustrate application patterns having a same duty ratio (50%: half of half waves of AC waveform with a predetermined cycle are selected).

In contrast, in a case where the control unit 614 determines that the duty ratio is a predetermined threshold or below (step S53: Yes), an application pattern that satisfies the duty ratio is selected (step S56).

The control unit 614 performs setting such that a waveform with a predetermined phase angle is selected after predetermined time t1 from the selected half wave of the AC waveform (step S57), and further performs setting such that a waveform with a predetermined phase angle is selected after predetermined time t2 from the selection of the waveform with a predetermined phase angle (step S58).

Thereafter, the control unit 614 overlaps the waveform with the predetermined phase angle toward the selected application pattern under the conditions set in steps S57 and S58, and then, performs energization to the heater 611 with the generated waveform (step S59).

Figures 7A, 7B, 7C:
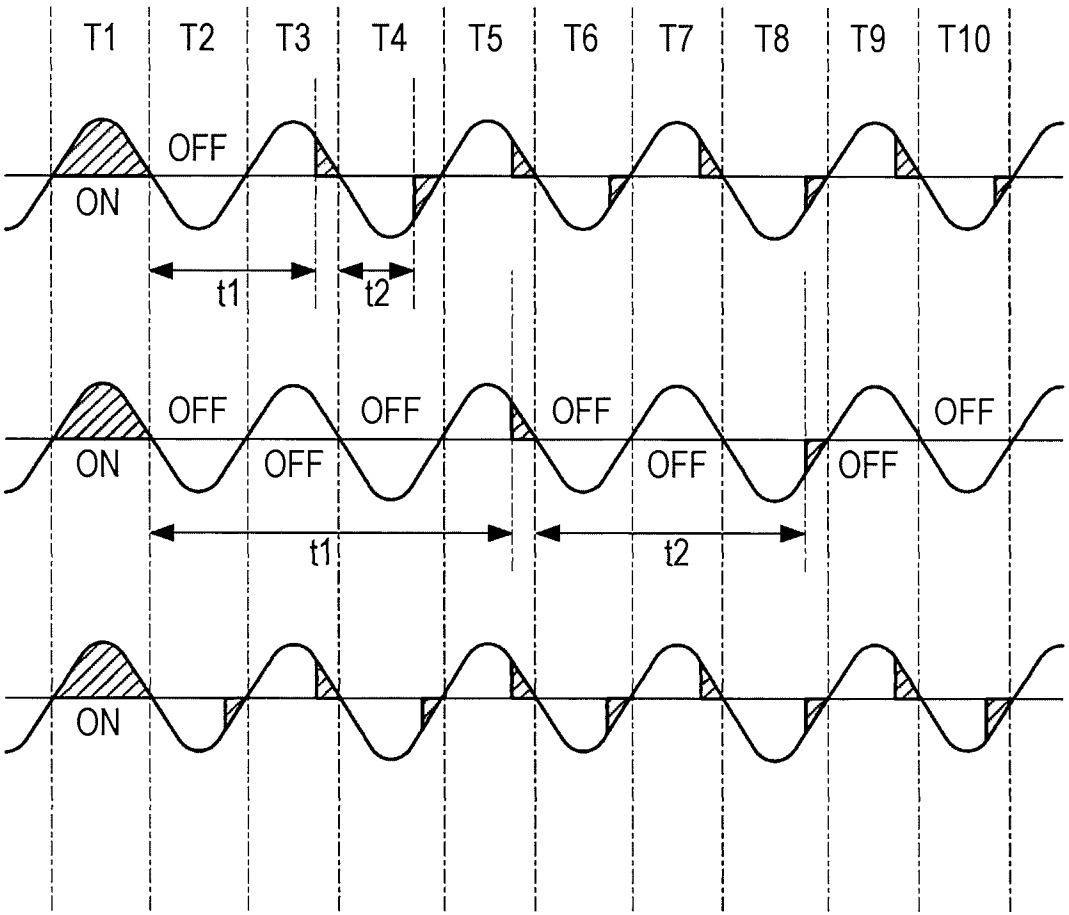
FIGS. 7A to 7C are diagrams illustrating another exemplary application pattern.

For example, as illustrated in FIG. 7A, the application pattern set in this manner has a waveform such that a half wave of the AC waveform is selected in the cycle T1, and then, a waveform with a predetermined phase angle is selected in the cycle T3, namely, after a predetermined time t1, and then, a waveform with a predetermined phase angle is to be sequentially selected after a predetermined time t2, namely, in the cycle T4, to the cycle T10.

Finally, the control unit 614 determines whether the predetermined cycles have finished (step S60). If it determines that the predetermined cycles have not finished (step S60: No), processing returns to step S59. If the control unit 614 determines that the predetermined cycles have finished (step S60: Yes), the control unit 614 determines whether to finish temperature control (step S61).

In a case where the control unit 614 determines not to finish temperature control (step S61: No), the processing returns to step S51, and in a case where the control unit 614 determines to finish temperature control (step S61: Yes), the processing is to be finished.

In this manner, a waveform with a predetermined phase angle is selected after the predetermined time t1 from the selected half wave of the AC waveform, and a waveform with a predetermined phase angle is further selected after the predetermined time t2 from the selection of the waveform with the predetermined phase angle. With this procedure, the heater 611 is heated by energization by the waveform of the predetermined phase angle in a predetermined interval, in addition to being heated by the half wave of the selected AC waveform. As a result, it is possible to prevent a decrease in the temperature of the heater 611 and prevent generation of flickering due to inrush current even when the duty ratio of the application pattern is a predetermined threshold or below.

As described above, the fixing apparatus 6 according to the present embodiment includes the heater 611 configured to heat the fixing member, the temperature detection unit 615 configured to detect the temperature of the heater 611, and the control unit 614 configured to calculate an application pattern based on the output of the temperature detection unit 615, and to appropriately select a half wave of the AC waveform and supply it to the heating unit as drive power by controlling the switching element 613 based on the application pattern. The control unit 614 selects a waveform with a predetermined phase angle on a non-selected half wave by controlling the switching element 613 according to the duty ratio of the application pattern, and supplies the power equivalent to the waveform of the phase angle to the heater 611, making it possible to prevent generation of flickering even when the duty ratio of the application pattern is a predetermined threshold or below.

In the description of embodiments, as illustrated in FIG. 7A, a waveform with the predetermined phase angle is selected after the predetermined time t1 from the selected half wave of the AC waveform, and the waveform with the predetermined phase angle is sequentially selected after the predetermined time t2 from the selection of the waveform with the predetermined phase angle. The values of the predetermined time t1 and the predetermined time t2 are not intended to be limited to this example.

That is, it is possible, as illustrated in FIG. 7B, to set the predetermined time t1 and the predetermined time t2 to longer time according to the heat storage amount of the heater 611.

Typically, the heater 611 easily heats up in a case where the selected half wave of the AC waveform is supplied as drive power, and on the contrary, the heater 611 does not easily heat up in a case the waveform with the predetermined phase angle (shorter time compared with the half wave) is supplied as drive power. Accordingly, the temperature of the heater 611 would not drop to such a low level as to provoke inrush current even when the predetermined time t1 is set to a longer time than the predetermined time t2, and thus, it is possible to prevent generation of flickering. Because of this, in order to suppress power consumption of the fixing apparatus 6, the relationship between the two predetermined times would be preferably t1>t2.

Alternatively, the value of the predetermined time t2 may be varied corresponding to the heat storage amount (heat storage property) of the heater 611. Specifically, in a case where the heat storage amount of the heater 611 is large, it means the heater easily heats up, and it is allowable to set the predetermined time t2 to be longer. Conversely, in a case where the heat storage amount of the heater 611 is small, the predetermined time t2 may be set to be shorter.

In the description of embodiment, as illustrated in FIG. 7A, the half wave immediately after the selected half wave of the AC waveform is turned "off". It is however, allowable to select a waveform with a predetermined phase angle on all the non-selected half waves. For example, as illustrated in FIG. 7C, it is also allowable to select a waveform with a predetermined phase angle on a half wave immediately after the selected half wave of the AC waveform.

The description of embodiment includes an exemplary case of the fixing apparatus 6 that uses the single heater 611. The description may also be applicable to the fixing apparatus that includes a plurality of heaters such as a central heater and an end heater.

In this case, the values of the predetermined time t1 and the predetermined time t2 may be varied between the plurality of heaters based on the level of the heat storage amount of the plurality of heaters. For example, the values of the predetermined time t1 and the predetermined time t2 may be set to be longer for the heater with a larger heat storage amount, and the values of the predetermined time t1 and the predetermined time t2 may be set to be shorter for the heater with a smaller heat storage amount. With this control, it is possible to suppress an increase in power consumption of the fixing apparatus 6 due to unnecessary overheating of the heater with larger heat storage amount.

The description of embodiments includes the fixing apparatus 6 that is configured to arrange the fixing roller 61*a* and the pressure roller 61*b* to form a nip portion N to convey the sheet M by holding the sheet M between the two rollers. Alternatively, it is allowable to configure such that the fixing apparatus 6 includes a heating roller as a heating member, and a fixing belt. In this case, the fixing belt may be stretched across the heating roller and the fixing roller 61*a*, and the fixing roller 61*a* together with the pressure roller 61*b* may configure the nip portion N to hold and convey the sheet M, via the fixing belt.

The description of embodiments includes the exemplary image forming apparatus 100 configured to include image forming units for individual colors of yellow (Y), magenta (M), cyan (C) and black (K), and to form a color image on the sheet M. The image forming apparatus is not intended to be limited to this example, but may be an image forming apparatus that forms, for example, a monochromatic image.

Although the description of embodiments assumes the fixing roller and the pressure roller as separate portions, they may be assumed as a pair of fixing members.

In the description of embodiments, a sheet is assumed as an exemplary recording medium. The recording medium, however, is not limited to a sheet of paper but may be any sheet-formed material on which a toner image can be formed and fixed. Other exemplary materials may include non-woven fabric, a plastic film, and leather.

Although the present invention has been described and illustrated in detail, it is clearly understood that the same is by way of illustrated and example only and is not to be taken by way of limitation, the scope of the present invention being interpreted by terms of the appended claims.

What is claimed is:

1. A fixing apparatus configured to fix a coloring material attached to a recording medium by heating the recording medium by using a fixing member, the fixing apparatus comprising:

a heater configured to heat the fixing member;

an AC power source configured to apply AC voltage to the heater;

a temperature detection unit configured to detect a temperature of the heater; and a power control unit configured to control drive power supplied to the heater from the AC power source by calculating an application pattern of AC voltage to be applied to the heater based on an output of the temperature detection unit, and by appropriately selecting a half wave of AC waveform from the AC power source based on the application pattern, wherein the power control unit supplies power equivalent to a waveform with a predetermined phase angle on a non-selected half wave, from the AC power source to the heater, according to a duty ratio of the application pattern, wherein the power control unit supplies, to the heater, power equivalent to a waveform with a predetermined phase angle on a portion of non-selected half waves, and wherein the power control unit controls such that a first time period after supply of the drive power till a subsequent supply of power equivalent to a waveform with a predetermined phase angle on a non-selected half wave becomes longer than a second time period after the subsequent supply of power equivalent to a waveform with a predetermined phase angle on a half wave on the non-selected half wave till another subsequent supply of power equivalent to a waveform with a predetermined phase angle on a non-selected half wave.

2. The fixing apparatus according to claim 1, wherein the power control unit supplies, to the heater, power equivalent to a waveform with a predetermined phase angle on all of non-selected half waves.

3. The fixing apparatus according to claim 1, wherein the power control unit controls the phase angle based on a heat storage amount of the heater.

4. An image forming apparatus comprising:

an image forming unit configured to form a toner image on a recording medium; and the fixing apparatus according to claim 1 configured to fix the toner image to the recording medium by causing the recording medium on which the toner image is formed to pass through the fixing apparatus.

5. A fixing apparatus configured to fix a coloring material attached to a recording medium by heating the recording medium by using a fixing member, the fixing apparatus comprising:

a plurality of heaters configured to heat the fixing member;

an AC power source configured to apply AC voltage to the heater;

a temperature detection unit configured to detect a temperature of the heater; and a power control unit configured to control drive power supplied to the heater from the AC power source by calculating an application pattern of AC voltage to be applied to the heater based on an output of the temperature detection unit, and by appropriately selecting a half wave of AC waveform from the AC power source based on the application pattern, wherein the power control unit supplies power equivalent to a waveform with a predetermined phase angle on a non-selected half wave, from the AC power source to the heater, according to a duty ratio of the application pattern, and wherein the power control unit controls, based on a heat storage amount of the heater, such that a time period, on a first heater, in which power equivalent to a waveform with a predetermined phase angle on a non-selected half wave is not supplied is different from a time period, on a second heater, in which power equivalent to a waveform with a predetermined phase angle on a non-selected half wave is not supplied.

6. An image forming apparatus comprising:

an image forming unit configured to form a toner image on a recording medium; and the fixing apparatus according to claim 5 configured to fix the toner image to the recording medium by causing the recording medium on which the toner image is formed to pass through the fixing apparatus.

7. A fixing apparatus configured to fix a coloring material attached to a recording medium by heating the recording medium by using a fixing member, the fixing apparatus comprising:

a heater configured to heat the fixing member;

an AC power source configured to apply AC voltage to the heater; and a power control unit configured to control drive power supplied to the heater from the AC power source by calculating an application pattern of AC voltage to be applied to the heater, and by appropriately selecting a half wave of AC waveform from the AC power source based on the application pattern, wherein the power control unit supplies power equivalent to a waveform with a predetermined phase angle on a non-selected half wave, from the AC power source to the heater, according to a duty ratio of the application pattern, wherein the power control unit supplies, to the heater, power equivalent to a waveform with a predetermined phase angle on a portion of non-selected half waves, and wherein the power control unit controls such that a first time period after supply of the drive power till a subsequent supply of power equivalent to a waveform with a predetermined phase angle on a non-selected half wave becomes longer than a second time period after the subsequent supply of power equivalent to a waveform with a predetermined phase angle on a half wave on the non-selected half wave till another subsequent supply of power equivalent to a waveform with a predetermined phase angle on a non-selected half wave.

8. The fixing apparatus according to claim 7, wherein the power control unit supplies, to the heater, power equivalent to a waveform with a predetermined phase angle on all of non-selected half waves.

9. The fixing apparatus according to claim 7, wherein the power control unit controls the phase angle based on a heat storage amount of the heater.

10. An image forming apparatus comprising:

an image forming unit configured to form a toner image on a recording medium; and the fixing apparatus according to claim 7 configured to fix the toner image to the recording medium by causing the recording medium on which the toner image is formed to pass through the fixing apparatus.

11. A fixing apparatus configured to fix a coloring material attached to a recording medium by heating the recording medium by using a fixing member, the fixing apparatus comprising:

a plurality of heaters configured to heat the fixing member;

an AC power source configured to apply AC voltage to the heater; and a power control unit configured to control drive power supplied to the heater from the AC power source by calculating an application pattern of AC voltage to be applied to the heater, and by appropriately selecting a half wave of AC waveform from the AC power source based on the application pattern, wherein the power control unit supplies power equivalent to a waveform with a predetermined phase angle on a non-selected half wave, from the AC power source to the heater, according to a duty ratio of the application pattern, and wherein the power control unit controls, based on a heat storage amount of the heater, such that a time period, on a first heater, in which power equivalent to a waveform with a predetermined phase angle on a non-selected half wave is not supplied is different from a time period, on a second heater, in which power equivalent to a waveform with a predetermined phase angle on a non-selected half wave is not supplied.

12. An image forming apparatus comprising:

an image forming unit configured to form a toner image on a recording medium; and the fixing apparatus according to claim 11 configured to fix the toner image to the recording medium by causing the recording medium on which the toner image is formed to pass through the fixing apparatus.

* * * * *